US008819897B2

(12) United States Patent
Nuckolls et al.

(10) Patent No.: US 8,819,897 B2
(45) Date of Patent: Sep. 2, 2014

(54) DURABLE LOW-VIBRATION LONG ARM HINGE APPARATUS

(71) Applicant: Hardware Resources, Inc., Bossier City, LA (US)

(72) Inventors: Grant Nuckolls, Bossier City, LA (US); Travis McElveen, Bossier City, LA (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

(21) Appl. No.: 13/663,075

(22) Filed: Oct. 29, 2012

(65) Prior Publication Data

US 2014/0115826 A1 May 1, 2014

(51) Int. Cl.
*E05D 3/06* (2006.01)

(52) U.S. Cl.
USPC ..... 16/366

(58) Field of Classification Search
CPC ..... E05D 3/16; E05D 7/0407; E05D 7/125; E05D 11/1021; E05D 3/12; E05D 3/10; E05Y 2900/20
USPC ..... 16/366, 368, 369, 370, 387, 277, 286, 16/295, 302, 257, 258
See application file for complete search history.

(56) References Cited

U.S. PATENT DOCUMENTS 1,030,936 A * 7/1912 Soss ..... 16/369
1,925,209 A * 9/1933 Schwartz ..... 16/358
2,021,702 A * 11/1935 Soss ..... 16/369
2,163,713 A * 6/1939 Soss ..... 16/379
2,596,816 A * 5/1952 Lieberman ..... 16/358
2,674,761 A * 4/1954 Weiss ..... 16/288
2,694,216 A * 11/1954 Schnur ..... 16/369
3,001,224 A * 9/1961 Soss ..... 16/276
3,590,420 A * 7/1971 Salice ..... 16/335
3,772,735 A * 11/1973 Lautenschlaeger ..... 16/237
4,332,053 A * 6/1982 Salice ..... 16/370
4,347,644 A * 9/1982 Lautenschlager et al. ..... 16/50
4,359,803 A * 11/1982 Lautenschlager ..... 16/272
4,368,559 A * 1/1983 Oepping et al. ..... 16/386
4,376,324 A 3/1983 Lautenschlager et al.
4,499,631 A 2/1985 Lautenschlager
4,558,485 A * 12/1985 Rock et al. ..... 16/370
4,615,074 A * 10/1986 Lautenschlager et al. ..... 16/370
4,641,396 A * 2/1987 Rock et al. ..... 16/370
4,760,623 A * 8/1988 Toyama ..... 16/238
4,799,289 A 1/1989 Grass
4,817,241 A * 4/1989 Koch et al. ..... 16/238
4,881,297 A 11/1989 Grass
4,884,316 A 12/1989 Masuda (Continued)

FOREIGN PATENT DOCUMENTS

EP 342293 A1 * 11/1989 ..... E05D 3/06
JP 06212851 A * 8/1994 ..... E05D 3/06

*Primary Examiner* — Victor Batson
*Assistant Examiner* — Jason W San
(74) *Attorney, Agent, or Firm* — Schultz & Associates, P.C.

(57) ABSTRACT

Disclosed is a long arm quick release hinge comprised of a hinge cup pivotally connected to a hinge body with a hinge pin via a hinge arm and a link in a four-bar linkage arrangement. The link is a collection of plates with interlocking projections and indentions arranged adjacent to each other and separated by resilient shock absorbing spacers. The hinge body is adjustably connected to a connecting plate with an overlay screw and an adjustment screw.

16 Claims, 7 Drawing Sheets

(56) References Cited

U.S. PATENT DOCUMENTS

| | | | | | |
|---|---|---|---|---|---|
| 5,105,506 | A | * | 4/1992 | Lin | 16/258 |
| 5,210,907 | A | * | 5/1993 | Toyama | 16/258 |
| 5,239,730 | A | | 8/1993 | Grass | |
| 5,245,727 | A | * | 9/1993 | Sasaki | 16/258 |
| 5,276,944 | A | * | 1/1994 | Lin | 16/258 |
| 5,481,782 | A | | 1/1996 | Grabher | |
| 5,511,287 | A | * | 4/1996 | Lautenschlager et al. | 16/239 |
| 5,937,479 | A | * | 8/1999 | Ohshima et al. | 16/257 |
| 6,032,333 | A | | 3/2000 | Brustle | |
| 6,061,872 | A | * | 5/2000 | Albrecht et al. | 16/258 |
| 6,088,879 | A | * | 7/2000 | Gasser | 16/257 |
| 6,141,832 | A | * | 11/2000 | Salice | 16/366 |
| 6,446,306 | B1 | * | 9/2002 | Salice | 16/245 |
| 6,805,248 | B2 | | 10/2004 | Champion et al. | |
| 7,059,018 | B2 | * | 6/2006 | Koshikawa et al. | 16/302 |
| 7,197,790 | B1 | * | 4/2007 | Edmondson | 16/336 |
| 7,322,072 | B2 | * | 1/2008 | Lin et al. | 16/252 |
| 7,383,615 | B2 | * | 6/2008 | Pozzi | 16/272 |
| 7,480,962 | B2 | * | 1/2009 | Takamatsu et al. | 16/382 |
| 7,754,950 | B2 | * | 7/2010 | Leach | 84/293 |
| 7,861,376 | B2 | * | 1/2011 | Fitz et al. | 16/286 |
| 7,966,696 | B2 | * | 6/2011 | Krammer | 16/286 |
| 7,966,699 | B2 | | 6/2011 | Dubach et al. | |
| 8,418,317 | B2 | * | 4/2013 | Wu et al. | 16/50 |
| 2008/0289146 | A1 | * | 11/2008 | Chen | 16/372 |
| 2012/0090135 | A1 | * | 4/2012 | Soh | 16/250 |

* cited by examiner

DURABLE LOW-VIBRATION LONG ARM HINGE APPARATUS

FIELD OF THE INVENTION

The present invention relates to heavy-use hinges for furniture products. In particular, the present invention relates to hinges capable of sustained use under frequent and heavy loads.

BACKGROUND OF THE INVENTION

Standard millwork and cabinetry hardware, such as recessed hinges, are not designed for use in applications where component pieces are heavy, use is frequent, or where high security is required. In these cases and others, wear on the hinges and hardware causes the need for frequent replacement, maintenance and adjustment.

Hardware replacement, maintenance and adjustment are time consuming and often expensive. For example, adjustment is usually required in more than one dimension. If the application has two or more hinges, as is usually the case in heavy duty applications, adjustments must be carried out on each hinge.

The prior art is replete with hinge designs. However, most prior art hinges suffer from various disadvantages including difficulty of installation, fragility of components, complicated construction, and high manufacturing costs.

A hinge design that is typical of the prior art is shown in FIGS. 1A and 1B. Hinge cup 10 is pivotally connected to hinge body 12 by hinge arm 14 and hinge link 16. Hinge arm 14 and hinge link 16 are connected to the hinge cup and the hinge body by pins 11, 13, 15 and 18. Pins 11, 13, 15, and 18 are generally aligned parallel to each other and provide rotational axes for the hinge arm and the hinge link. The hinge body, hinge cup, hinge arm, and hinge link comprise a four-bar linkage. Hinge link 16 is stamped from a flat sheet. Formed integrally in the hinge link are "hinge eyes" 20 and 22. The hinge eyes are formed typically by rolling the flat sheet about a desired diameter.

As shown in FIG. 1B, pin 18 is seated in hinge eyes 20 and 22 and forms a pivot for the hinge link. Gaps 24 and 26 exist due to clearance required for hinge link 16 to pivot. Gaps 24 and 26 can be seen between hinge link 16 and hinge body 12. Gaps 24 and 26 allow for unwanted movement of hinge link 16 along pin 18 to occur under heavy loads.

As shown in FIG. 1C, in many heavy duty applications the components of the cabinet are subjected to high forces. For example, force 25 in a downward direction parallel to the hinge pins causes deflection of the hinge eyes. In extreme cases, the deflection results in a permanent and cumulative deformation of the hinge eyes. Permanent deformation allows hinge link 16 to disengage from pin 18, causing misalignment of the rotational axes and ultimately hinge failure. In another example, high frequency usage of cabinet components causes repetitive loading and vibration which in turn causes widening of the hinge eyes and eventual hinge failure.

Therefore, a need exists for an easily installed, robust, simple and affordable hinge capable of withstanding excessive loading and excessive force while still delivering precision and durable motion to the cabinet door.

SUMMARY OF THE INVENTION

A preferred embodiment is comprised of a hinge cup pivotally connected to a hinge body by a four-bar linkage arrangement. In one embodiment, the four-bar linkage includes a hinge arm and hinge link connected to the hinge cup and hinge body with a set of pins. The hinge link includes a series of uniquely shaped and interlocked plates separated by shock absorbing spacers. The plates include matching projections and indentions. The spacers are sized to a press fit between the plates to create a resilient connection between the hinge link and the hinge body. The hinge body is laterally adjustable with respect to the connecting plate through an overlay screw threaded in the hinge body and slidably engaged with a slot in the connecting plate. The hinge body is longitudinally adjustable with respect to the connecting plate perpendicular to the axis of the hinge pin through an adjustment screw threaded in the connecting plate and slidably engaged with an oblong hole in the hinge body.

Those skilled in the art will appreciate the above-mentioned features and advantages of the invention together with other important aspects upon reading the detailed description that follows in conjunction with the drawings.

DETAILED DESCRIPTION OF THE PREFERRED EMBODIMENT

In the description that follows, like parts are marked throughout the specification and figures with the same numerals, respectively. The figures are not necessarily drawn to scale and may be shown in exaggerated or generalized form in the interest of clarity and conciseness.

Figure 1A:
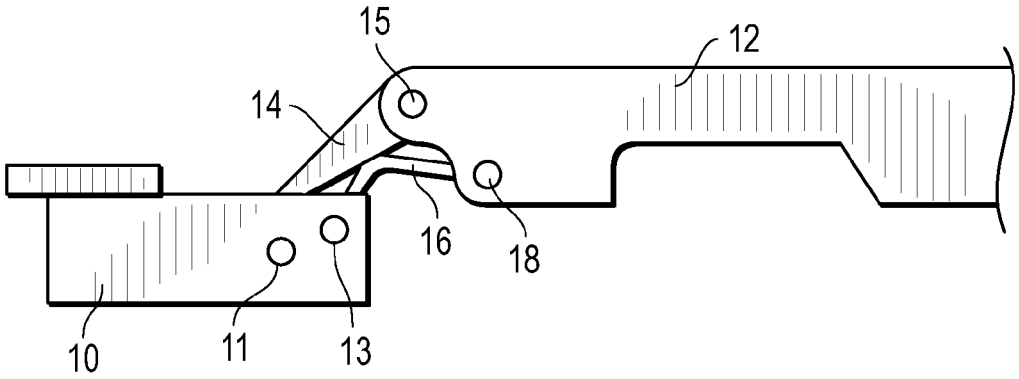
FIG. 1A (Prior Art)
FIG. 1A is an elevation view of a prior art hinge.
Figure 1B:
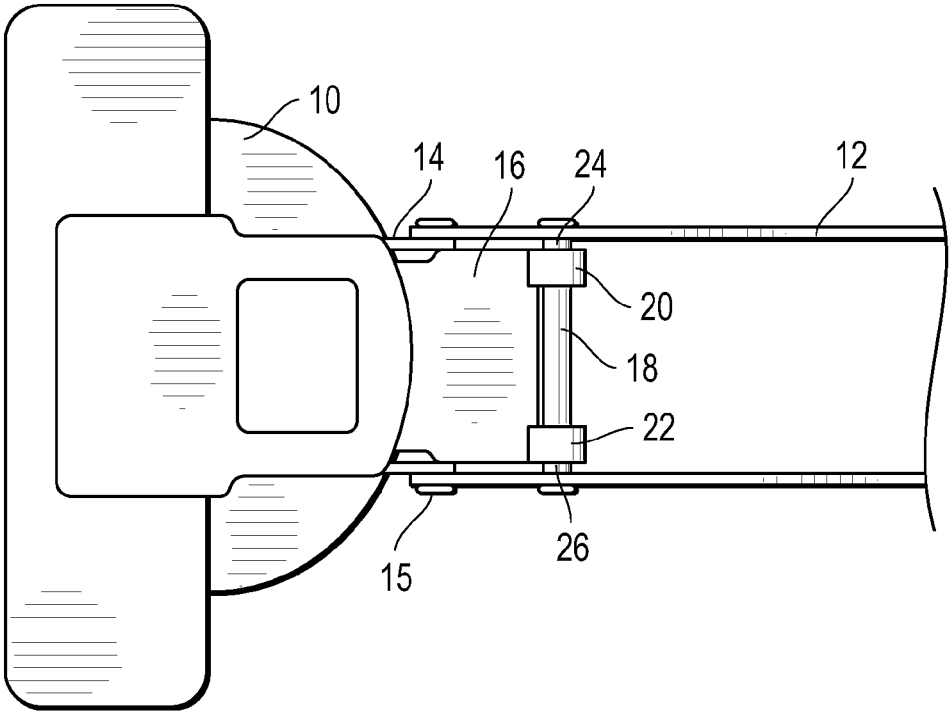
FIG. 1B (Prior Art)
FIG. 1B is a plan view of a prior art hinge.
Figure 1C:
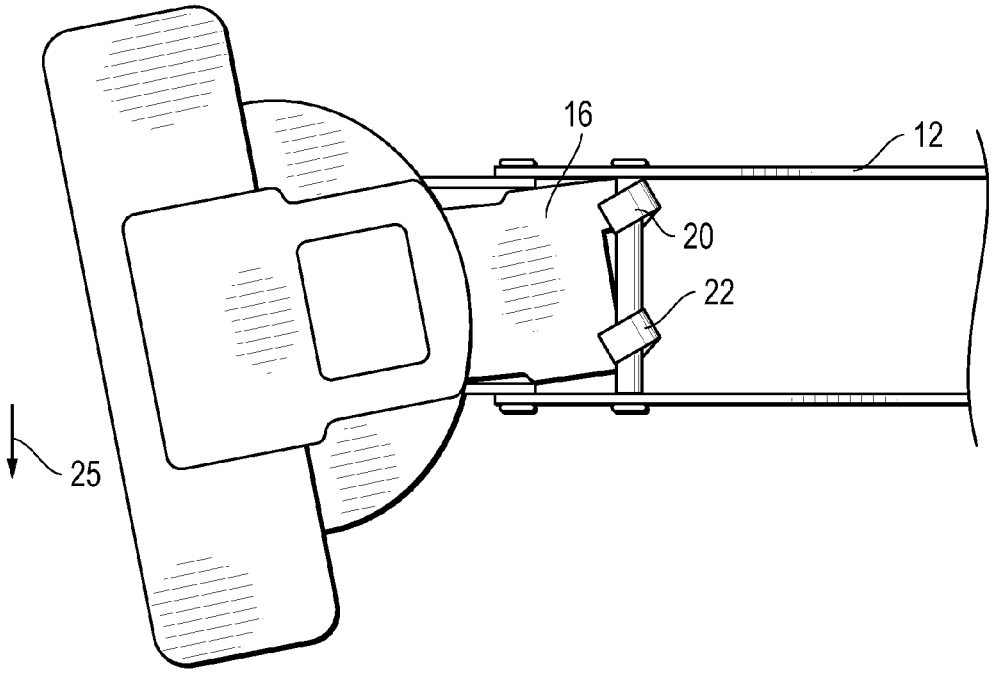
FIG. 1C (Prior Art)
FIG. 1C is a plan view of a deformed prior art hinge.
Figure 2:
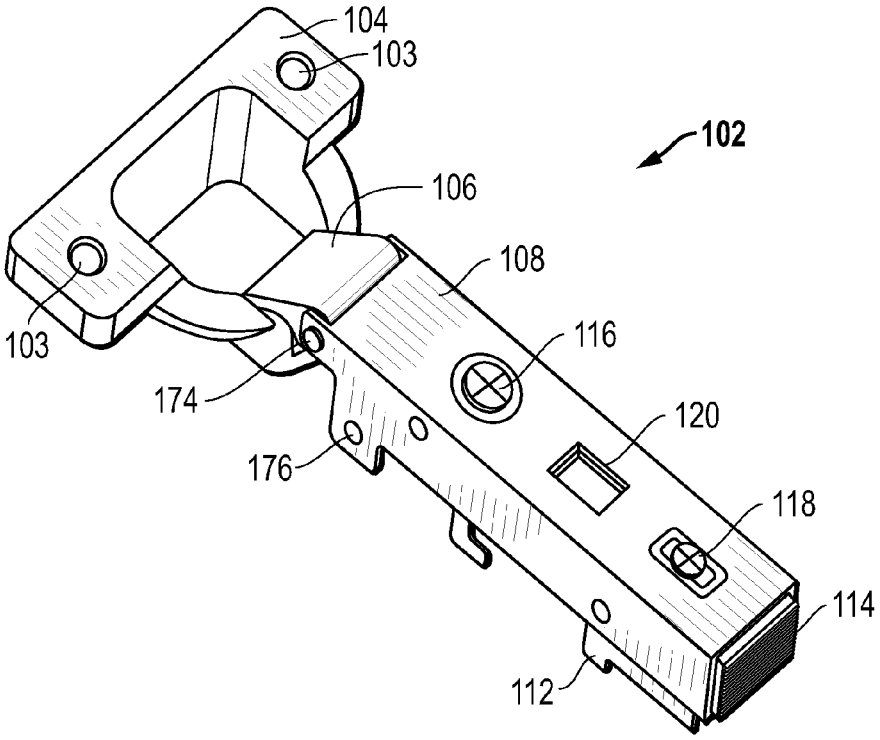
FIG. 2 is a perspective view of a preferred embodiment of the hinge.
Figure 3:
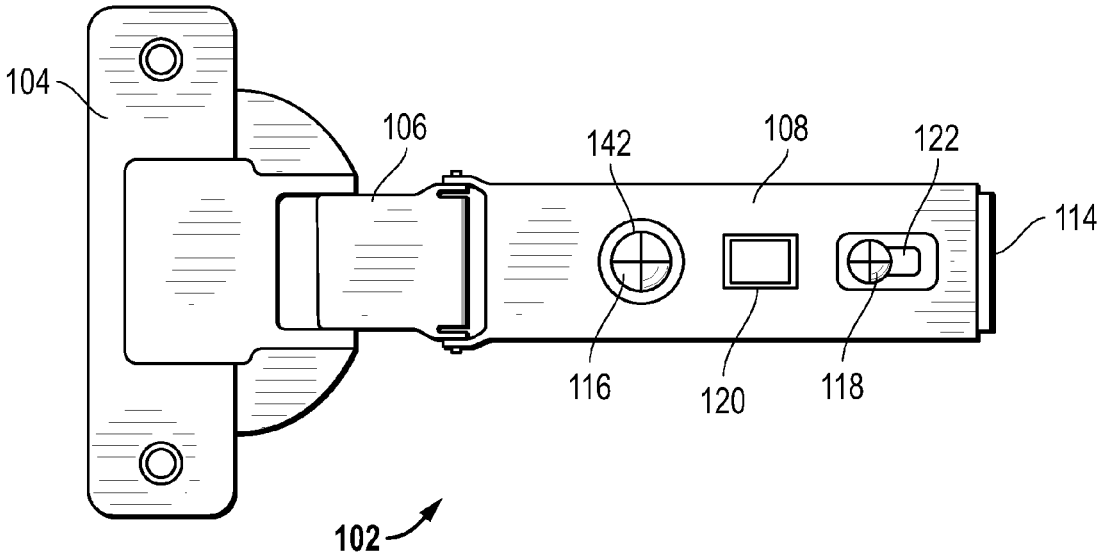
FIG. 3 is a plan view from the top of a preferred embodiment of the hinge.

Referring to FIGS. 2 and 3, hinge 102 includes hinge cup 104, affixed to a cabinet door (not shown) with screws through holes 103. Hinge cup 104 is pivotally connected to hinge arm 106 and hinge link 110 by hinge pin 128. Hinge pin 128 is of a unitary construction forming a "U-shape." Those skilled in the art will recognize that hinge pin 128 can be replaced by separate keeper pins.

Figure 4:
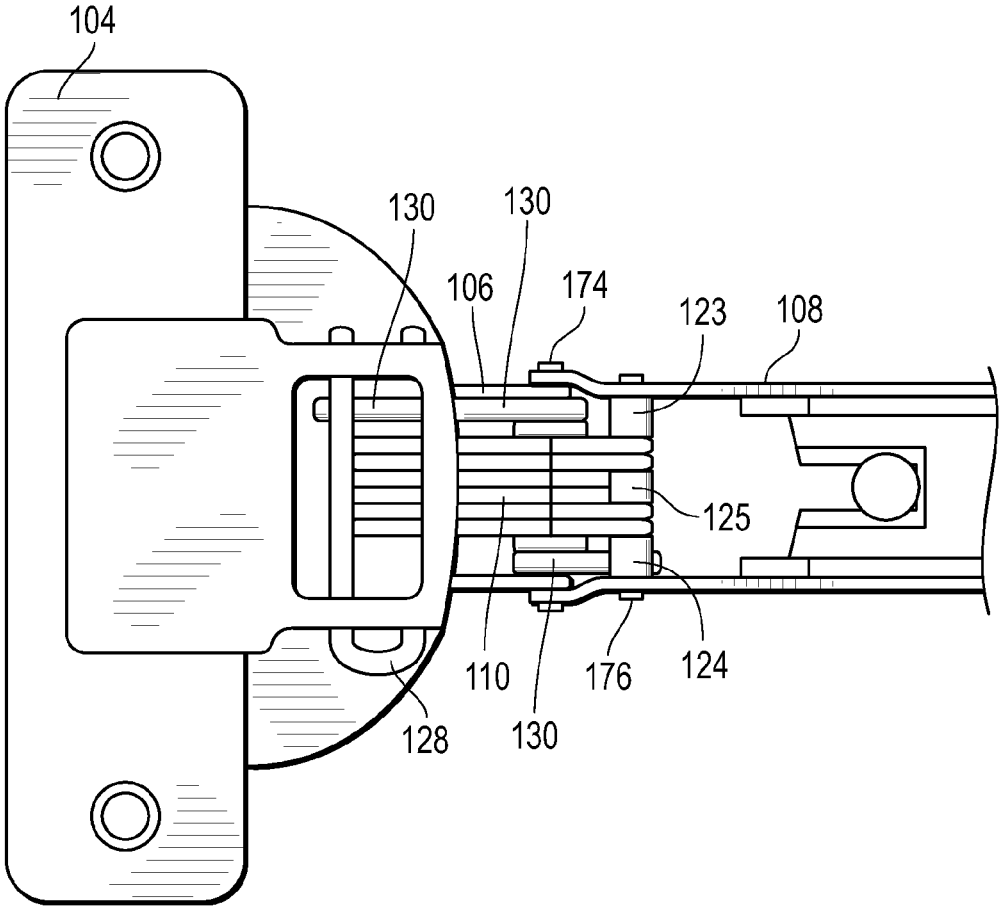
FIG. 4 is a detail view of the plates, spacers and spring of a preferred embodiment.
Figure 5:
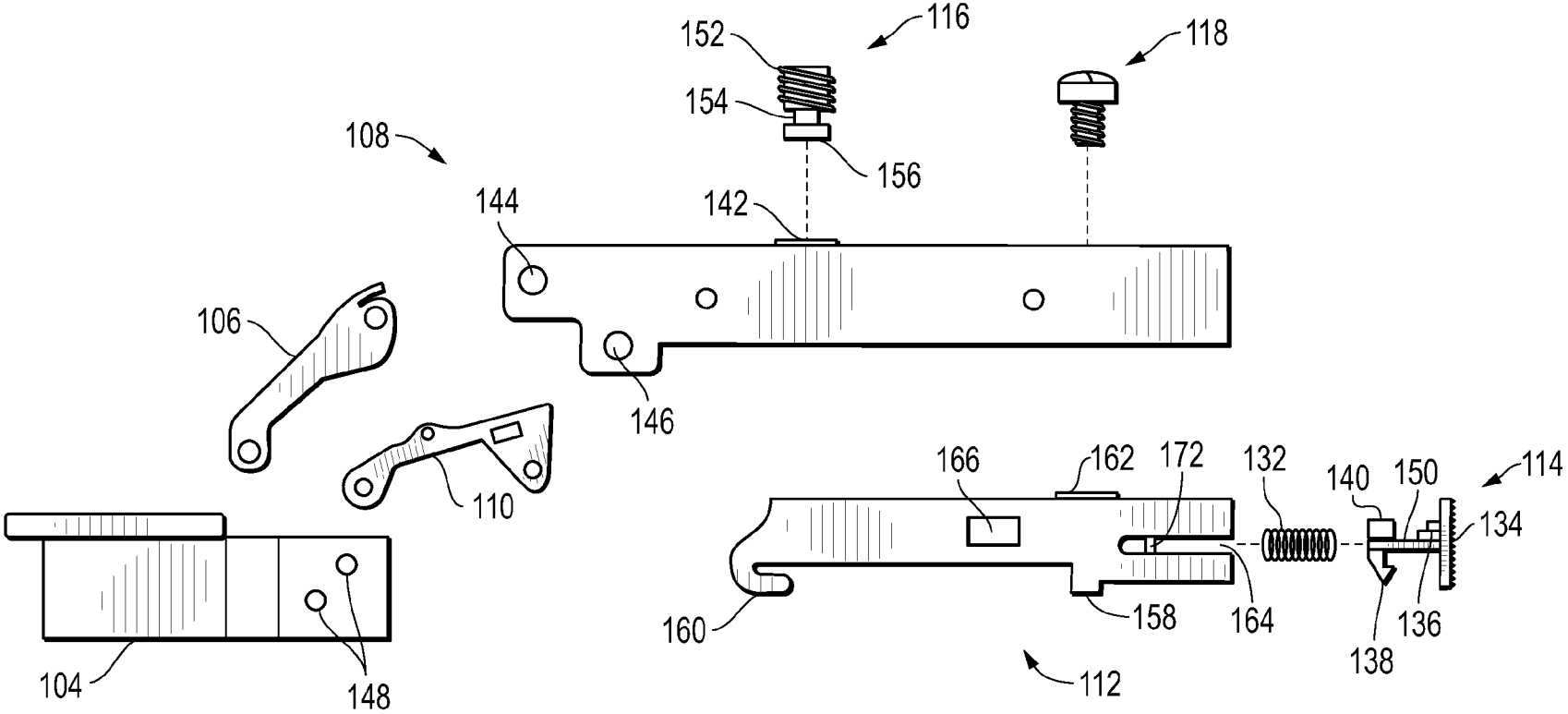
FIG. 5 is an exploded elevation view of a preferred embodiment of the hinge.

Referring to FIGS. 4 and 5, hinge arm 106 and hinge link 110 are pivotally connected to hinge body 108 at pin 174 and pin 176, respectively. Thus, a four-bar linkage is formed. Coil spring 130 surrounds pin 174 and biases hinge in either an open or closed position. Connecting plate 112 is adjustably connected to hinge body 108 by overlay screw 116 and adjustment screw 118. In the preferred embodiment, connecting plate 112 is releasably connected to a mounting plate (not shown) where the mounting plate is securely affixed to a furniture part. Typically, the mounting plate is affixed with a mounting screw and the location of the mounting plate can be adjusted in a vertical plane without removing the mounting screw completely.

Hinge cup 104 includes hinge pin holes 148. Hinge pin holes 148 are located on each side of hinge cup 104 and are sized to receive hinge pin 128. As a result, the U-shaped hinge pin passes through hinge cup 104 at pin holes 148 and forms pivot axes for hinge arm 106 and hinge link 110.

Hinge body 108 includes a generally channel shaped cross section. Each lateral side of hinge body 108 includes pivot hole 144 and pivot hole 146. Pivot holes 144 on each side of hinge body 108 are axially aligned and are sized to accommodate pin 174. Pivot holes 146 on each side of hinge body 108 are axially aligned and are sized to accommodate pin 176. The longitudinal axes of pins 174 and 176 are parallel to the pivot axes of hinge pin 128.

The upper surface of hinge body 108 includes threaded hole 142 and oblong hole 122. Threaded hole 142 receives the threaded section of overlay screw 116. Overly screw 116 includes threaded section 152 and disk 156 separated by shaft 154. Adjustment screw 118 passes through oblong hole 122. Hinge body 108 further includes opening 120 positioned between threaded hole 142 and oblong hole 122.

As shown in FIG. 5, release assembly 114 has a ridged face 134 integrally formed with base 150. Spring seat 136 is integrally formed with base 150 and is adjacent the back side of face 134. Seat 140 is integrally formed with base 150 and opposes spring seat 136. Hook 138 extends from the underside of base 150 just below seat 140. Release assembly 114 is slidably engaged with connecting plate 112. The edges of base 150 slide within slots 164. Seat 140 is positioned behind tab 172. Coil spring 132 is adjacent tab 172 and spring seat 136. Coil spring 132 biases release assembly 114 away from and out of connecting plate 112. A force applied to face 134 towards connecting plate 112 compresses coil spring 132 thus transitioning hook 138 towards hinge cup 104. Once the force is removed, coil spring 132 pushes release assembly 114 away from hinge cup 104.

In a preferred embodiment, the components of hinge 102 are typically constructed of metal such as cast aluminum or steel alloy plate stock and formed by stamping.

Figure 6:
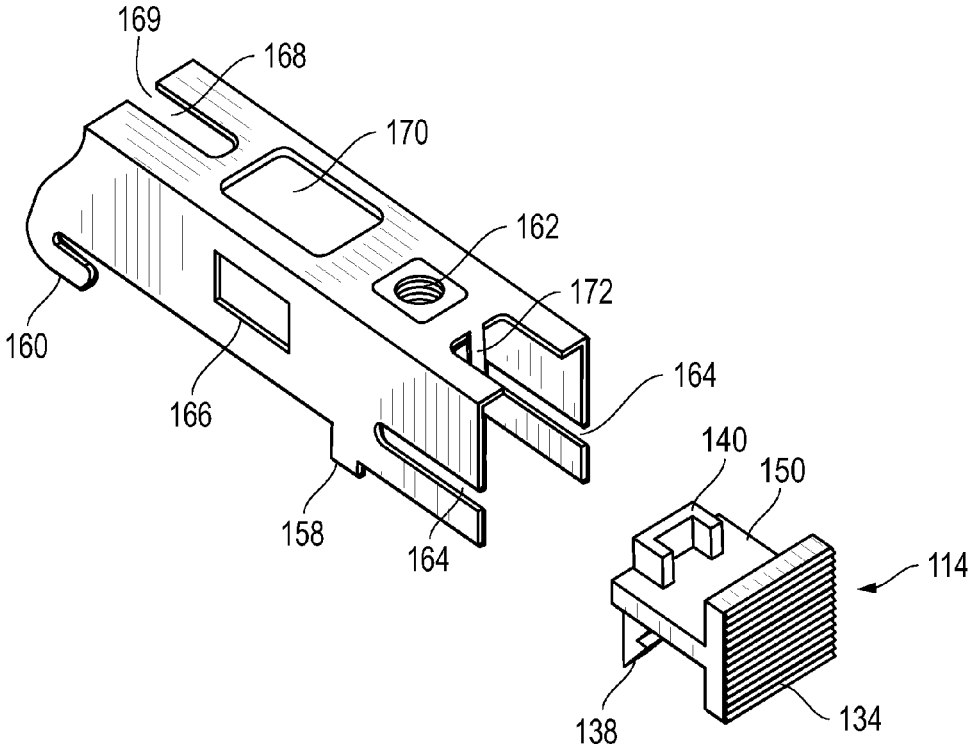
FIG. 6 is an exploded perspective view of a preferred embodiment of the connecting plate of the hinge.

As shown in FIG. 6, connecting plate 112 has a generally channel shaped cross section. The lateral sides of the connecting plate are mirror images and include hook 160, slot 164, and shoulder 158. The upper surface of connecting plate 112 includes slot 168 centrally positioned between the lateral sides. Slot 168 is oblong in shape having open end 169. Opening 170 is generally rectangular and, when connecting plate 112 is connected to hinge body 108, is aligned with opening 120 of hinge body 108. Threaded hole 162 engages the threads of adjustment screw 118. Tab 172 is centrally positioned between the lateral sides and extends generally perpendicularly into the interior space of connecting plate 112. Opening 166 is generally rectangular and is located on the lateral sides of connecting plate 112.

Figure 7:
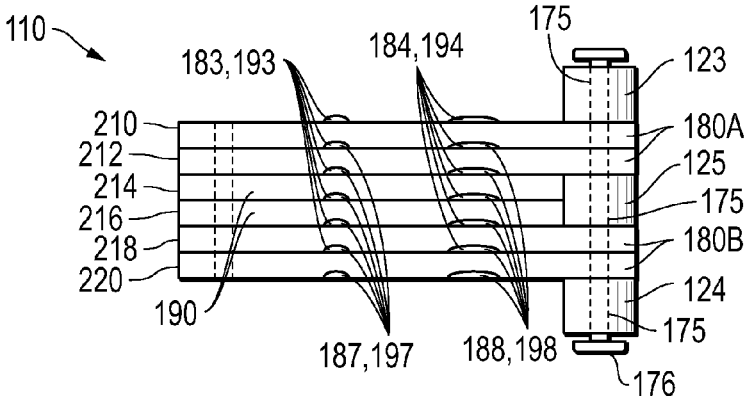
FIG. 7 is a plan view from the underside of a preferred embodiment of the link and spacers of the hinge.
Figure 8A:
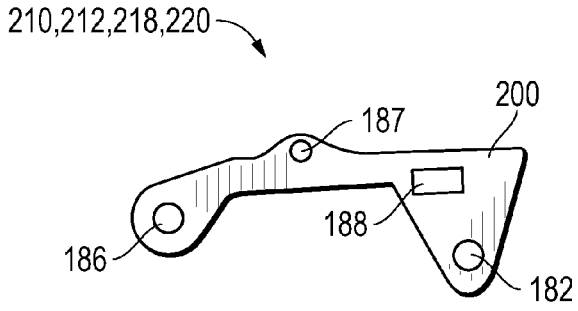
FIG. 8A is a plan view of a preferred embodiment of a plate of the hinge.
Figure 8B:
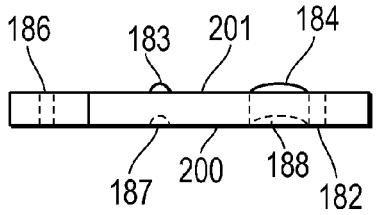
FIG. 8B is an elevation view of a preferred embodiment of a plate of the hinge.
Figure 9A:
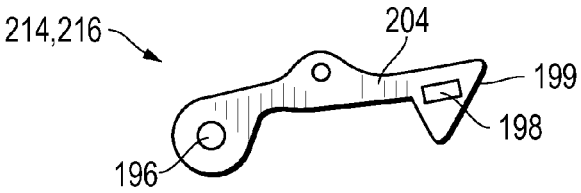
FIG. 9A is a plan view of a preferred embodiment of a plate of the binge.
Figure 9B:
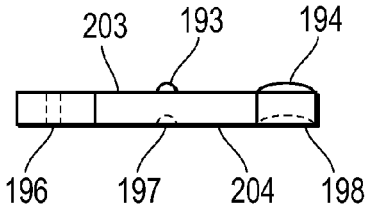
FIG. 9B is an elevation view of a preferred embodiment of a plate of the hinge.

Referring to FIG. 7, hinge link 110 is comprised of a collection of interlocking plates separated by shock absorbing spacers. In a preferred embodiment, hinge link 110 includes six individual plates 210, 212, 214, 216, 218, and 220. Plates 210, 212, 218, and 220 are identical and are shown in FIGS. 8A and 8B. Plates 214 and 216 are identical and are shown in FIGS. 9A and 9B. In alternate embodiments, different combinations and total numbers of plates may be incorporated depending on the desired use and durability required.

Referring to FIGS. 8A and 8B, plates 210, 212, 218, and 220 include pivot hole 186 and pivot hole 182. Pivot hole 186 receives hinge pin 128 and pivotally connects plates 210, 212, 218, and 220 to hinge cup 104. Pivot hole 182 receives pin 176 and pivotally connects plates 210, 212, 218, and 220 to hinge body 108. Plates 210, 212, 218, and 220 further include rectangular projection 184 and circular projection 183 on side 201. A matching rectangular indention 188 and circular indention 187 are present on side 200 of plates 210, 212, 218, and 220.

Referring to FIGS. 9A and 9B, plates 214 and 216 include pivot hole 196. Pivot hole 196 receives hinge pin 128 and pivotally connects plates 214 and 216 to hinge cup 104. Plates 214 and 216 further include rectangular projection 194 and circular projection 193 on side 203 and rectangular indention 198 and circular indention 197 on side 204. Plates 214 and 216 also include edge 199. In a preferred embodiment, each plate is formed by a single stamping operation. A single die is used to cut the plates from stock material and form the required indentions and projections.

When assembled, plates 210, 212, 214, 216, 218, and 220 interlock in a side by side arrangement. The projections from one plate mate with the indentions of the adjacent plate to ensure a unitary fit and to prevent the plates from moving relative to each other. Plates 210 and 212 form plate group 180A. Plates 218 and 220 form plate group 180B. Plates 214 and 216 form plate group 190.

Figure 10:
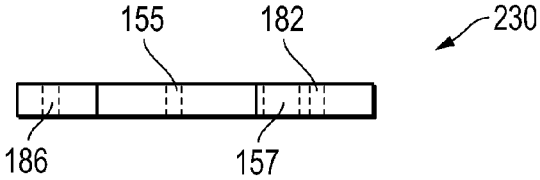
FIG. 10 is an elevation view of an alternate embodiment of a plate of the hinge.

An alternate embodiment, plate 230, is shown in FIG. 10. Plate 230 includes circular hole 155 and rectangular hole 157. Plate 230 includes pivot holes 182 and 186 for pivotally connecting to the hinge body and the hinge cup. In an alternate arrangement of hinge link 110, plate 230 replaces plate 210. Plate 230 interlocks with plate 212 as circular projection 183 and rectangular projection 184 of plate 212 mate with circular hole 155 and rectangular hole 157 of plate 230. Plate 230 has no projections, therefore hinge parts, such as spring 130, can slide adjacent hinge link 110 unencumbered, if necessary.

Referring again to FIG. 7, spacers 123, 124, and 125 are described. In a preferred embodiment, spacers 123, 124, and 125 are cylindrical, have a circular cross section, and may freely rotate. Each spacer includes a hole 175 for receiving pin 176. Spacers 123 and 124 are fitted opposite lateral sides of hinge body 108. Spacer 123 is adjacent plate 210. Spacer 124 is adjacent plate 220. Spacer 125 is positioned between spacers 123 and 124 and adjacent plate 212 and plate 218. Spacer 125 is also nested against edge 199 of plates 214 and 216. Hole 175 of each spacer 123, 124, and 125 is coaxially aligned with pivot hole 182 and pin 176.

In a preferred embodiment, the spacers are sized so that a press fit is required in holes 175 and between hinge body 108. In preferred embodiments, the spacers are formed of a semi-rigid plastic polymer material such as Teflon® or Dekin®. The materials are also resilient and so can be repeatedly compressed both axially and radially and will return to their original dimensions.

In another preferred embodiment, the cross sectional shape of the spacers can be rectangular or oblong. Such alternate shapes (or others) prevent rotation of the spacers about their common axis. Any combination of spacer shapes may be used.

In use, the spacers serve at least three functions. First, they preserve the spacing of plate groups 180A and 180B, axially along pivot hole 182 relative to each other and relative to hinge body 108. Preservation of correct spacing reduces or eliminates deformation during heavy loading and increases durability. Second, since the spacers are resilient, they act as shock absorbers, thus allowing impact movement of the plates relative to each other, but returning them to their original positions before plastic deformation can occur. The shock absorbing function prevents excessive wear on the parts by reducing or eliminating impact loading damage to hole 182 and pivot pin 176. Thirdly, the spacers absorb vibration and thereby reduce "rattle." In particular, the nesting of spacer 125 against edges 199 of plate group 190, absorbs and reduces vibration between plate groups 180A, 190, and 180B.

When assembled, hinge cup is typically mounted in a door part with mounting hardware such as wood or machine screws. A mounting plate (not shown) is mounted to a frame part. Hook 160, shoulder 158, and spring loaded hook 138 engage corresponding connection hooks and tabs formed in the mounting plate to releasably connect connecting plate 112 to the mounting plate. A force applied to release assembly 114 allows for quick connection and quick release. Connecting plate 112 is adjustably connected to hinge body 108. Overlay screw 116 is threadably engaged with threaded hole 142 such that shaft 154 and disk 156 are situated underneath the top surface of hinge body 108. Shaft 154 is seated in slot 168 such that disk 156 is underneath the top surface of connecting plate 112. Opening 170 is generally aligned with opening 120. Adjustment screw 118 passes through oblong hole 122 and engages threaded hole 162.

Hinge 102 provides adjustment in two directions after mounting. One direction of adjustment is the horizontal or "in and out" movement of the cabinet door. This adjustment is required when the inside face of the door does not lay flush with the cabinet frame thus impeding the opening and closing action. To effect the horizontal adjustment, adjustment screw 118 is loosened by rotating adjustment screw in the counter-clockwise direction. Hinge body 108 can now be adjusted relative to connecting plate 112 through a length equal to the length of oblong hole 122. Once the desired position is achieved, adjustment screw 118 is tightened such that hinge body 108 no longer slides with respect to connecting plate 112.

Another direction of adjustment is the lateral or "side to side" movement of the cabinet door. This adjustment is also referred to as an overlay adjustment. This adjustment is required when the vertical edges of the cabinet door do not align with the vertical edges of the cabinet frame or the vertical edges of an adjacent cabinet door. In most applications, more than one hinge 102 is used to mount a cabinet door. Providing different lateral adjustments on two different hinges provides an angular adjustment to the cabinet door with respect to the cabinet frame.

To effect the lateral adjustment, overlay screw 116 is rotated. Depending on the orientation of threads 152 and threaded hole 142, rotating overlay screw 116 such that overlay screw 116 advances in towards hinge body 108 causes the bottom of threads 152 to abut the top surface of connecting plate 112 and moves hinge body 108 away from connecting plate 112 creating distance between the two. Rotating overlay screw 116 such that overlay screw 116 retreats out of threaded hole 142 causes disk 156 to abut the underside of connecting plate 112 and moves hinge body 108 towards connecting plate 112 removing distance between the two. As the distance between hinge body 108 and connecting plate 112 increases or decreases, a lateral movement of the cabinet door with respect to the cabinet frame is achieved.

It should be noted that the installation orientation with the hinge cup fitted into a bore opening on a door and the hinge arm fitted on to the frame, could be reversed even though this is not the usual practice. In addition, the hinge of the present invention may be used in other applications that require a heavy duty hinge treatment, including furniture, security doors, safes, and the like.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A hinge assembly comprising:

a hinge body having a generally U-shaped cross section comprised of an upper surface and a first side and a second side, where the first side and the second side each include a pivot hole;

a pivot pin inserted through the pivot holes;

a hinge arm pivotally connected to the hinge body and a hinge cup;

a link pivotally connected to the hinge cup and pivotally connected to the hinge body via the pivot pin, where the link is comprised of a first set of plates, a second set of plates, and a third set of plates;

a first spacer, coaxially aligned with the pivot pin, adjacent the first side and the first set of plates;

a second spacer, coaxially aligned with the pivot pin, adjacent the first set of plates, an edge of the second set of plates, and the third set of plates; and a third spacer, coaxially aligned with the pivot pin, adjacent the third set of plates and the second side.

2. The hinge assembly of claim 1 wherein each plate of the first set of plates, the second set of plates, and the third sets of plates is arranged side by side.

3. The hinge assembly of claim 1 further comprising:

a projection of a first plate of the first set of plates engaged with an indention of a second plate of the first set of plates;

a projection of the second plate of the first set of plates engaged with an indention of a first plate of the second set of plates;

a projection of the first plate of the second set of plates engaged with an indention of a second plate of the second set of plates;

a projection of the second plate of the second set of plates engaged with an indention of a first plate of the third set of plates; and, a projection of the first plate of the third set of plates engaged with an indention of a second plate of the third set of plates.

4. The hinge assembly of claim 1 wherein a first plate of the first set of plates has a first hole and a second hole and wherein a first projection on a second plate of the first set of plates engages the first hole and a second projection on the second plate of the first set of plates engages the second hole.

5. The hinge assembly of claim 1 wherein each plate of the first set of plates, the second set of plates, and the third sets of plates is arranged side by side and further comprises a pair of projections on a first side and a pair of indentions on a second side.

6. The hinge assembly of claim 1 further comprising:

a pair of projections of a first plate of the first set of plates engaged with a pair of indentions of a second plate of the first set of plates;

a pair of projections of the second plate of the first set of plates engaged with a pair of indentions of a first plate of the second set of plates;

a pair of projections of the first plate of the second set of plates engaged with a pair of indentions of a second plate of the second set of plates;

a pair of projections of the second plate of the second set of plates engaged with a pair of indentions of a first plate of the third set of plates; and, a pair of projections of the first plate of the third set of plates engaged with a pair of indentions of a second plate of the third set of plates.

7. The hinge assembly of claim 1 wherein the first spacer, the second spacer, and the third spacer each has a generally circular cross section and is rotatable about the pivot pin.

8. The hinge assembly of claim 1 wherein the first spacer, the second spacer, and the third spacer are formed of semi-rigid plastic polymer.

9. The hinge assembly of claim 1 wherein the first spacer, the second spacer, and the third spacer have a cross section chosen from the group of circular, rectangular, and oblong.

10. The hinge assembly of claim 1 further comprising:

the upper surface further including a first threaded hole and an oblong hole;

a connecting plate having a generally U-shaped cross section comprised of a base surface including an open slot and a second threaded hole;

an overlay screw comprising a threaded section for threadably engaging the first threaded hole, a shaft extending from the threaded section, and a disk formed on the end of the shaft;

an adjustment screw extending through the oblong hole and threadably engaged with the second threaded hole;

wherein the connecting plate is adjustably connected to the hinge body as the shaft extends through the open slot and the disk is adjacent the connecting plate and the adjustment screw extends through the oblong hole and engages the second threaded hole;

wherein to make an overlay adjustment, the overlay screw is rotated such that a relative lateral distance between the hinge body and the connecting plate is altered; and, wherein to make a horizontal adjustment, the adjustment screw is rotated and a horizontal position of the hinge body relative to the connecting plate is altered.

11. A method of increasing shock absorption in and eliminating deformation of a hinge during loading comprising:

providing a hinge cup, a hinge body, a set of interlocking plates connecting the hinge cup and the hinge body, and a hinge arm adjacent the set of interlocking plates and connecting the hinge cup and the hinge body, forming a 4-bar linkage arrangement;

arranging each plate of the set of interlocking plates side by side where a first projection of a first interlocking plate of the set of interlocking plates engages a first indention of a second interlocking plate of the set of interlocking plates;

providing a set of resilient spacers coaxially aligned on a pivot pin, resiliently connecting the set of interlocking plates to the hinge body;

arranging a first resilient spacer of the set of resilient spacers adjacent the first interlocking plate of the set of interlocking plates, the second interlocking plate of the set of interlocking plates, and a third interlocking plate of the set of interlocking plates; and, wherein vibration of each plate of the set of interlocking plates relative to each plate of the set of interlocking plates is reduced and impact movement of each plate of the set of interlocking plates relative to each plate of the set of interlocking plates is allowed.

12. The method of claim 11 wherein the step of arranging each plate of the set of interlocking plates further comprises providing a plurality of interlocking plates.

13. The method of claim 12 further comprises providing the first interlocking plate of the set of interlocking plates with a first hole and a second hole, wherein a first projection of the second interlocking plate of the set of interlocking plates engages the first hole and a second projection of the second interlocking plate of the set of interlocking plates engages the second hole.

14. The method of claim 11 wherein the step of providing a set of resilient spacers further comprises providing each resilient spacer of the set of resilient spacers with a hole allowing force rotation about the pivot pin.

15. The method of claim 11 further providing a cross section chosen from the group of circular, rectangular, and oblong for each resilient spacer of the set of resilient spacers with a hole allowing force rotation about the pivot pin.

16. The method of claim 11 further comprising the step of forming each resilient spacer of the set of resilient spacers of a semi-rigid plastic polymer.

* * * * *